United States Patent [19]

Harris

[11] Patent Number: 4,651,454

[45] Date of Patent: Mar. 24, 1987

[54] SPEAR GUN HAVING GAS SEALING MEANS

[76] Inventor: Paul C. Harris, 8717 19th Place SW, Edmonds, Washington 98020

[21] Appl. No.: 731,046

[22] Filed: May 6, 1985

[51] Int. Cl.[4] ..... F41F 1/00

[52] U.S. Cl. ..... 42/1.14; 43/6; 102/430

[58] Field of Search ..... 42/1 L, 1 M; 102/524

[56] References Cited

U.S. PATENT DOCUMENTS

| | | | |
|---|---|---|---|
| D. 262,478 | 12/1981 | Beuchat | D22/3 |
| 2,725,048 | 11/1955 | Koogle | 42/1 L |
| 3,067,454 | 12/1962 | Catlin et al. | 42/1 L |
| 3,516,358 | 6/1970 | Manninen et al. | 102/524 |
| 3,585,934 | 6/1971 | Mueller | 42/1 L |
| 3,585,979 | 6/1971 | Hendricks | 124/22 R |
| 3,616,561 | 11/1971 | Hendricks | 42/1 L |
| 3,780,720 | 12/1973 | Alderson | 124/11 A |
| 3,838,532 | 10/1974 | Prodanovich | 42/1 L |
| 3,871,120 | 3/1975 | Mounier | 42/1 L |
| 4,019,480 | 4/1977 | Kenaio | 124/61 |
| 4,193,386 | 3/1980 | Rossi | 124/22 |
| 4,359,999 | 11/1982 | Garofalo | 124/80 |

*Primary Examiner*—Deborah L. Kyle
*Assistant Examiner*—Michael J. Carone
*Attorney, Agent, or Firm*—Gary T. Hampson

[57] ABSTRACT

A spear gun and a power load for use therewith, the spear gun including a breech, a barrel fixed to the breech, and a spear adapted to be received by a bore within the barrel. The breech includes a chamber for receiving an explosive power load, the chamber being in fluid communication with the bore. The spear is sized to substantially prevent the flow of gas between the spear and the bore and may include a gas restrictor proximate one end to further reduce the flow of gas past the spear. The power load has no projectile and includes an explosive sealed to prevent water damage to the explosive. A line retainer adapted to be carried by the spear includes a plurality of pins urged toward the spear, the pins being adapted to be received in a reduced portion of the spear.

11 Claims, 5 Drawing Figures

SPEAR GUN HAVING GAS SEALING MEANS

FIELD

The present invention is directed to the field of underwater diving equipment and more particularly to an improved spear gun and a power load for use therewith.

BACKGROUND

Several types of spear guns are known for use underwater and may generally be categorized by the type of propulsion employed for the spear. A first type of gun uses one or more elastic cords fixed near the tip of the gun. A spear is mounted on the gun and the cords are stretched and hooked to the spear. When the spear is released, the elastic cords rapidly contract, thereby propelling the spear. Spear guns of the type just described are disclosed, for example, in U.S. Pat. Nos. 3,585,979 and 4,193,386.

Although the elastic cord type of spear gun is very popular because of its simplicity, such spear guns suffer several significant disadvantages. The elastic cords degrade quickly when exposed to sun and salt water, the two elements in which the guns are commonly used. When the cords fail, it is most often while the gun is in use, making repair inconvenient and time consuming. Also, when the elastic cords are stretched and hooked to the spear, the cords quickly lose their tendency to return to their relaxed position. Consequently, some of the energy used to stretch the cords is lost before the spear is released. Another disadvantage associated with the elastic cord type of spear gun is that the gun usually is cocked, that is, the elastic cords stretched and hooked to the spear, while the user is in the water, a difficult and potentially dangerous procedure. Further, since the elasticity of the cords determines the range and effectiveness of the gun, guns with greater range and power require corresponding greater cocking efforts and thus are even more difficult and dangerous to use.

Yet another disadvantage of the elastic cord spear guns is that the trigger mechanism must hold the entire force of the elastic cords once the gun is cocked and then release the spear when the trigger is actuated. The large forces involved tend to quickly wear the trigger mechanism, requiring frequent service which, if not performed, can lead to an unsafe gun.

A second general type of spear gun is an air powered gun which uses compressed air to force a piston down a smooth barrel. A spear resting within the barrel is propelled by the piston as the piston travels down the barrel. The air which drives the piston may come from two sources, namely, from a cylinder of compressed air, known as "cylinder charged," or by forcing the piston back down the barrel and capturing the resulting compressed air, known as "compression charged." Cylinder charged guns may have considerable power and range but the large volume of air used with each firing of the gun requires an air cylinder that is large and difficult to handle. An example of the cylinder charged gun is disclosed in U.S. Pat. No. 4,019,480.

The compression charged gun is more popular than the cylinder charged gun and is often comparable in weight to elastic cord guns. Unfortunately, the effort required to recompress the air within the barrel is considerable and, as with the elastic cord guns, the cocking operation can be difficult and perhaps dangerous. A disadvantage common to both types of compressed air guns is that the piston requires an air seal that can move rapidly down the barrel. Such a seal is difficult to maintain, particularly in view of the speed at which the piston must move and the salt water and sand environment in which the guns operate. Consequently, both types of compressed air spear guns suffer from frequent seal failures.

Applicant is aware of a spear gun which uses a conventional .38 caliber firearm cartridge to propel a spear from the gun. The gun bears the legend "Mordem Brevettato, Italy" and it is believed that the gun was made in Italy during the late 1940's. The gun includes a spear that is loosely received within a barrel. The end of the spear that is received within the barrel includes an indentation that is adapted to receive the cartridge and in particular the projectile when the cartridge is fired. The Mordem gun, however, is ineffective and of little practical use. Because such gun uses a conventional firearm cartridge, the cartridge can become flooded with water, rendering the cartridge, and thus the gun, inoperative. If the cartridge does fire, the projectile is rammed into the indentation in the spear, transferring the momentum of the projectile to the spear. However, the mass of the spear is so much greater than the projectile that little force is actually transferred to the spear. Moreover, due to the loose fit of the spear within the barrel, expanding gas from the the cartridge largely blows ineffectively around and by the spear. The net result is that the spear is not propelled from the gun with any appreciable speed. Applicant believes that the Mordem gun was a commercial failure at least because of the low power associated therewith.

It is known in the art to use conventional firearm cartridges in what are often termed "power heads," that is, devices carried at the tip of spears which, upon impact with a target, cause the cartridge to detonate, propelling a dart or projectile into the target. Such devices are disclosed in U.S. Pat. Nos. 3,838,532 (Prodanovich) and 3,871,120 (Mounier). Prodanovich discloses the use of a conventional .22 caliber cartridge to propel a dart into the target upon inpact of the dart with the target. As an alternative, the dart may be dispensed with and the expanding gases and projectile from the cartridge can be used to immobilize smaller marine creatures. Mounier discloses an impact-activated underwater gun which uses a firearm cartridge including a projectile.

Both the Prodanovich and Mounier power heads are contact devices truly effective only when the devices contact or are in very close proximity with a target. With respect to Prodanovich, the force of impact of the projectile from the cartridge can damage the dart and the barrel within which the dart travels, an important disadvantage where long life and dependable service are needed.

Also known in the art are so-called "bang sticks" used to repell sharks and the like. Some of such bang sticks use a small waterproof shotgun-like cartridge mounted at the front of the stick. The cartridge is fired when the stick is directed so as to strike a shark, expelling pellets and a burst of expanding gases against the shark. However, as with power heads, bang sticks are only effective when in close proximity with a target.

SUMMARY OF THE INVENTION

The present invention overcomes the limitations and disadvantages set forth above with previously known spear guns. A gun in accordance with the present invention does not use elastic cords, a compressed air bottle, or easily worn air seals. The gun may be armed quickly without difficulty yet provides substantial power with each discharge. The gun does not use a conventional firearm cartridge and thus is not subject to the damage associated with the impact of a projectile into a spear or dart.

A spear gun in accordance with the present invention includes a barrel having an internal bore and a spear adapted to be received within the bore. The outer diameter of the spear is sized to substantially prevent the flow of gas between the spear and the bore. The gun further includes a breech adapted to receive and power load and includes means for firing the power load. The power load includes an explosive charge in a water tight case and advantageously includes no projectile.

The spear includes a tapered section and the gun further includes a line retainer having a central bore. The line retainer is disposed on the spear and the line retainer includes a plurality of moveable pins radially disposed about the central bore. The pins are biased inwardly toward the bore, the pins being adapted to slide along the spear and be received and retained at the tapered section. The line retainer may be conveniently repositioned by simply pushing the retainer toward the tip of the spear when the spear is reloaded into the barrel.

DETAILED DESCRIPTION

Figure 1:
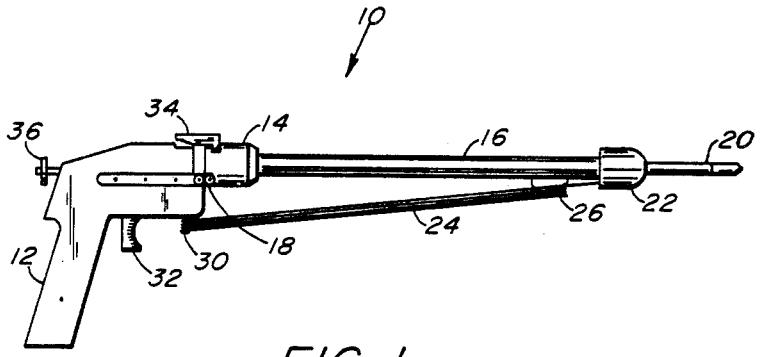
FIG. 1 is a side view of a spear gun in accordance with the present invention.

With reference to FIG. 1, a spear gun 10 in accordance with the present invention includes a body 12. A breech 14 and barrel 16 are hinged to the body 12 at a hinge 18. A spear 20 is received within the barrel 16 and a line retainer 22 is carried by the spear. A line 24 is gathered between a hook 26 near the free end of the barrel 16, and a line release 30, part of the body 12. One end of the line 24 is fixed to the line retainer 22 and the other end of the line is fixed to the hook 26. The body 12 includes a trigger 32 and a breech lock 34. The breech lock 34 secures the breech 14 and barrel 16 in a closed position against the body 12. A hammer 36 is carried by the body 12 and is used to cock the gun as is described below. The overall length of the gun 10 including the handle body 12, breech 14, barrel 16, line retainer 22 and spear 20, with the spear 20 received within the barrel 16, may be about eighteen to thirty-six inches.

Figure 2:
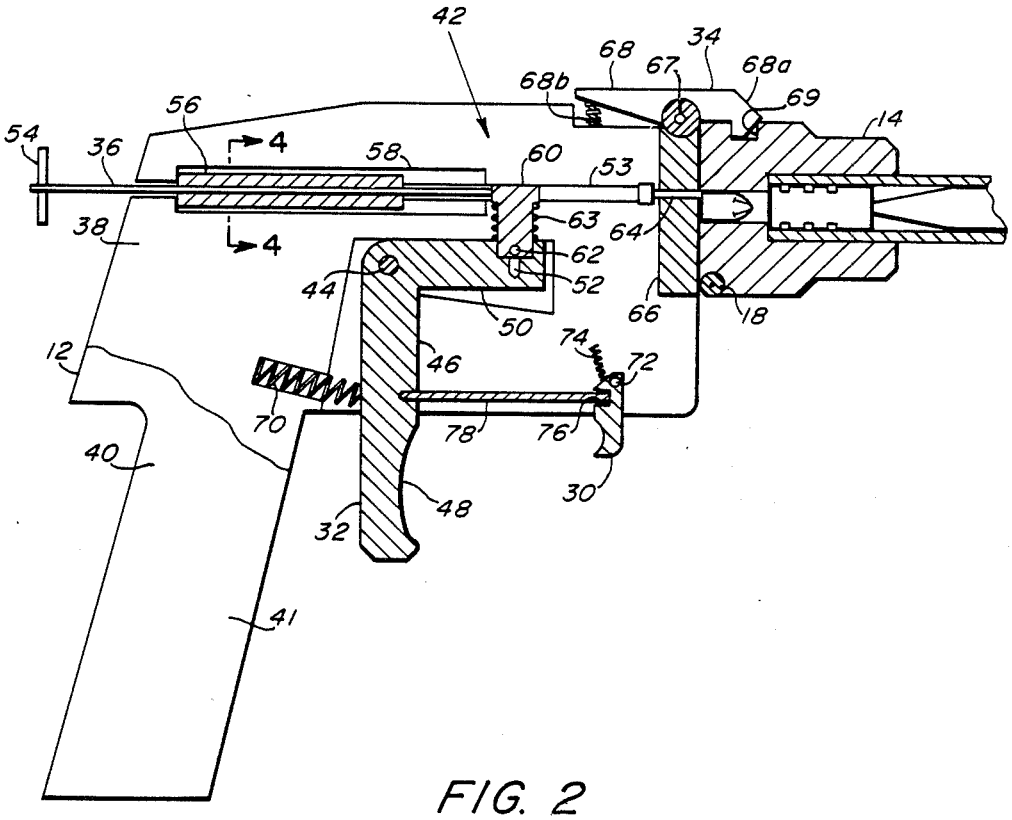
FIG. 2 is a cutaway view of the trigger mechanism of the spear gun of FIG. 1.

With reference to FIG. 2, the body 12 includes a trigger mechanism plate 38 and a cover plate 40. The body 12 is formed to define a grip 41 which may be angled slightly back as shown for ease of use. The grip 41 may include depressions (not shown) adapted to fit the individual fingers of the user as is known in the art. In FIG. 2, the cover plate 40 has been shown partially cutaway to reveal the trigger mechanism shown generally at 42. The trigger mechanism includes the trigger 32 which in greater detail comprises a generally L-shaped member pivoted at a pivot 44. A lower end 46 of the L-shaped member includes an indentation 48 adapted to receive and fit the trigger finger of a user. An upper generally horizontal portion 50 of the L-shaped member includes a vertical slot 52 disposed near the end of the member 50.

Figure 4:
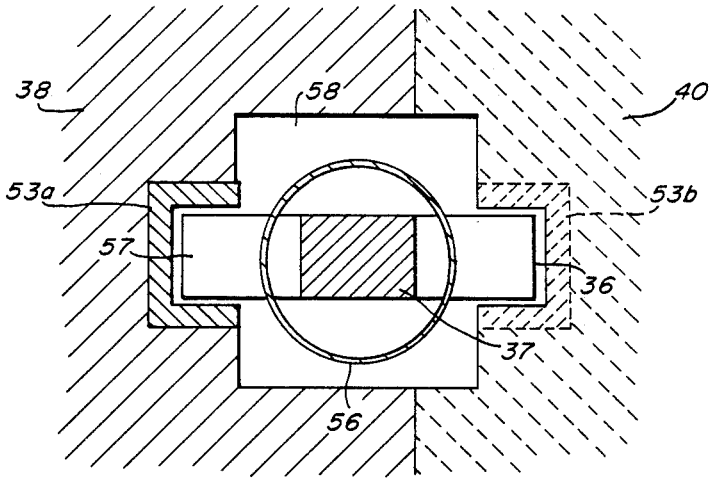
FIG. 4 is a view of the hammer shown partially in cross-section and hammer guide taken along line 4—4 of FIG. 2.

The hammer 36 is carried within a hammer guide 53, the hammer 36 including a bar 54 near the exterior end of the hammer 36 used to pull the hammer 36 into a cocked position. The hammer 36 as seen in FIG. 4 has a generally flat cross section, including a reduced portion 37 about which is disposed a helical spring 56. The spring 56 is received within a recess 58 and the spring 56 transfers its biasing force to a shoulder 57, urging the hammer 36 toward the breech 14 as seen in FIG. 2. The hammer guide 53 includes two U-shaped members 53*a* and 53*b*, the member 53*b* being shown in phantom in FIG. 4 as being part of the cut-away portion of the cover plate 40. A hammer release 60 (FIG. 2) is carried vertically within the trigger mechanism plate 38 and includes a pin 62 at its lower end. The pin 62 rides within the slot 52, the hammer release 60 being biased upwardly by a spring 63 toward the top of the hammer guide 53. The hammer release 60 may be moved downwardly against the bias of the spring 63 such that the top of the hammer release 60 clears the hammer guide 53. The trigger 32 is urged in a counter clockwise direction as viewed in FIG. 2 about the pin 46 by means of a spring 70. When so rotated to the position seen in FIG. 2, the hammer release 60 is urged upwardly into the hammer guide 53 when the hammer 36 is withdrawn to the left.

At the end of the hammer guide 53 opposite the recess 58 is disposed a firting pin 64. The firing pin 64 includes a enlarged portion adapted to the impacted by the hammer 36 and a reduced portion extending through a breech block 66. The range of travel of the firing pin 64 is such that the end of the reduced portion may move from a first position flush with the exterior surface of the block 66 to a second position extended slightly beyond the exterior surface.

The breech lock 34 is pivotally fixed at the top of the block 66 by means of a pin 67. The breech lock 34 includes a lever 68, a paw 68*a* and a spring 68*b*. The spring 68*b* biases the lever 68 and paw 68*a* about the pin 67 such that the paw 68*a* is adapted to engage a groove 69 to thereby hold the breech 14 against the block 66.

The line release 30 is pivoted about a pivot 72 and is biased in a clockwise direction as seen in FIG. 2 by means of a spring 74. The line release 30 includes a groove 76 for receiving a connecting rod 78. The rod 78 is connected to the trigger 32 just about the indentation 48 and is moveable with the trigger 32.

Figure 3:
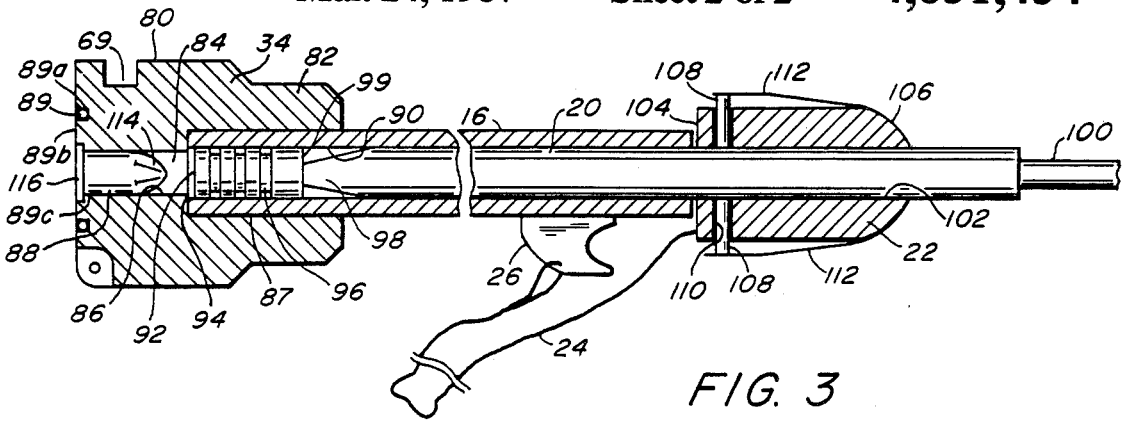
FIG. 3 is a view of the breech, barrel and line retainer of the spear gun of FIG. 1 shown in partial cutaway.

With reference to FIG. 3, the breech includes an enlarged section 80 which tapers into a reduced section 82. A central bore 84 is formed through the enlarged and reduced sections 80 and 82, the central bore in turn consisting of a power load chamber 86 and a barrel receiving portion 87 coaxially aligned with the chamber 86. The chamber 86 is adapted to receive a power load 88 as is described more fully hereinbelow. An O-ring 89 is concentrically aligned with the chamber 86 and is received within a groove 89*a* formed in an end surface 89*b* of the breech 34.

The barrel receiving portion 87 is threaded (not shown) and receives and retains a suitably threaded end of the barrel 16. In the embodiment disclosed herein, the barrel is about eighteen inches long and is manufactured of type 316 stainless steel tubing. The inside wall of the barrel 16 defines a bore 90. The spear 20 has an outside diameter sized to substantially prevent the flow of gas between the spear 20 and the bore 90. The spear 20 may have an outside diameter about 0.005 inch to 0.030 inch less than the inside diameter of the bore 90, and in the particular embodiment disclosed herein, a difference of 0.010 inch between the spear 20 outside diameter and the bore 90 inside diameter is used. The spear 20 includes an end 92 adapted to be received within the bore 90 and to rest against an annular shoulder 94 formed between the chamber 86 and barrel receiving portion 87. Proximate the end 92 are a plurality of circumferential grooves 96 formed about the spear 20. The spear 20 further includes a tapered section 98 tapering from the outside diameter of the spear 20 toward the end 92 to a smaller diameter cross section defining an annular surface 99 proximate the grooves 96. A second end 100 of the spear may be threaded (not shown) to receive various tips, such as the pointed spear tip shown in FIG. 1.

The line retainer 22 includes an inner bore 102 which slidably receives the spear 20. The retainer 22 may include a flat stop surface 104 at one end and a rounded tip 106 at a second end. A plurality of pins 108 are carried in radial bores 110 disposed about the inner bore 102. The pins 108 are urged toward the spear 20 by means of leaf springs 112, each of the springs 112 being fixed at one end to the line retainer 22 near the rounded tip 106. In the embodiment disclosed herein, two pins 108 are used in the line retainer 22.

Figure 5:
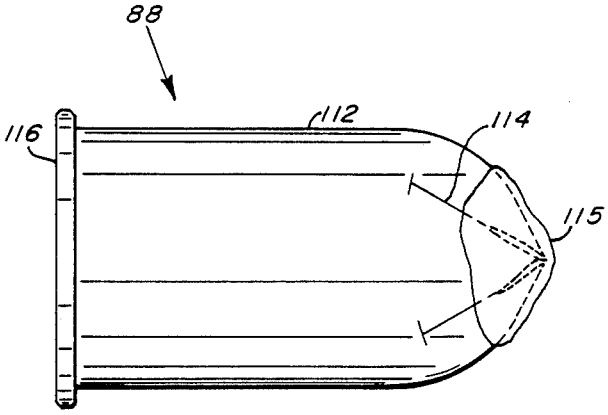
FIG. 5 is a side view of the inventive power load of FIG. 2.

With reference to FIG. 5, the power load 88 includes a casing 112 filled with an explosive charge and a crimped end 114 to retain such charge. The crimped end 114 is coated with a sealing compound 115 such as silicone rubber to seal the power load 88 from water. The power load 88 also includes a flanged end 116 which includes a rim-fire primer for igniting the charge within the power load 88. In the embodiment disclosed herein, the power load 88 is an explosive charge used in the construction trades to power fastener drivers such as a power hammer available from Remington, with the end 114 coated with a low viscosity room temperature vulcanizing (RTV) silicone rubber.

In use, the spear gun 10 in accordance with the present invention is easily and safely loaded yet provides considerable range and reliability. To load the gun 10, the breech lock 34 is rotated about the pin 67 to disengage the paw **68*a* from the groove 69. The breech 14 and barrel 16 are rotated about the hinge 18 to expose the chamber 86. The end 92 of the spear 20 is inserted into the barrel 16, coming to rest against the shoulder 94. The power load 88 is inserted into the chamber 86, the flanged end 116 of the power load 88 being received within the annular groove 89*a*. The breech 14 and barrel 16 are then rotated about the hinge 18 to close the end surface against the breech block 66, the O-ring 89*a* providing a seal between the breech 14 and the breech block 66**.

The hammer 36 is drawn out of the body 12 by grasping and pulling the bar 54 until the hammer 36 is past the hammer release 60. The hammer release 60 then moves upwardly into the hammer guide 53. The hammer may then be released and is urged against the hammer release 60 by the spring 56. The line release 30 is rotated about the pin 72 in a clock-wise direction until the rod 78 engages the groove 76, locking the line release 30 in place. The line 24 may then be wound between the hook 26 and line release 30, thus holding the line 24 in place and urging the line retainer 22 against the end of the barrel 16. As so configured, the gun 10 is ready to be fired.

To fire the gun, the trigger 32 is rotated about the pin 44, releasing the line release 30 and drawing the hammer release 60 downwardly. Once the hammer release 60 is moved out of the way of the hammer 36, the hammer 36, under the urging of the spring 56, slides rapidly along the hammer guide 53. The flat cross-section of the hammer 36 as compared to the larger cross-sectional area of the recess 58 allows water displaced by the hammer 36 during its movement to be easily moved aside, thus not impeding the movement of the hammer 36. The hammer 36 strikes the firing pin 64 which in turn strikes the flanged end 116 of the power load 88. The rim primer within the power load 88 ignites, causing the explosive within the power load to detonate and producing an explosion which opens the crimped end 114 of the power load 88. A large volume of rapidly expanding gas produced by the power load 88 pushes against the end 92 of the spear 20 and accelerates the spear 20 down the barrel 16, the grooves 96 serving as a series of pressure interruptors or dynamic seals to interfere with and inhibit the escape of the expanding gases within the barrel 16.

As the now rapidly moving spear 20 exits the barrel, the pins 108 carried by the line retainer 22 are urged along the tapered section 98 by the leaf springs 112, causing the pins to engage the annular surface 99. With the pins 108 so engaged, the line retainer travels with the spear 20, playing out the line 24 as the spear moves through the water.

The spear may be recovered by pulling in the line 24. To reload the gun 10, the breech lock 34 is rotated to release the breech 14 and barrel 16 and both are rotated about the hinge 18. The end 92 of the spear 20 is fitted into the end of the barrel 16 and pushed toward the breech 14, popping the spent power load 88 from the chamber 86. Once the flat stop surface 104 of the line retainer 22 contacts the end of the barrel, the pins 108 ride up the tapered section 98 against the bias of the leaf springs 112 and ride along the spear 20 until the spear is against the shoulder 94. The gun may then be reloaded and prepared as described above for another firing.

The spear gun of the present invention thus is easily and rapidly reloaded underwater, yet imparts considerable velocity to the spear. The present invention is a significant improvement over the art and presents a spear gun with a range comparable to the most powerful prior spear guns, yet can be easily and quickly loaded without the maintenance difficulties associated with prior spear guns.

Various modifications to the spear gun 10 of the present invention will be apparent to those skilled in the art which will not depart from the scope of the appended claims. For example, the leaf springs 112 may be replaced by a rubber cord stretched about the ends of the pins 108. Further, other embodiements of the trigger and line release mechanisms will be apparent and various types of sealing compounds, such as wax or other polymers, may be used to seal the power load 88.

The present invention is not to be limited by the above detailed description but shall be given the full scope of the appended claims and all equivalents thereof.

I claim:

1. A spear gun for use underwater with an explosive power load, the power load having no projectile, the spear gun comprising a barrel having an internal bore;

a spear adapted to be received within the bore, the outer diameter of the spear being within a range of about 0.005 to 0.030 inch less than the diameter of the bore, the difference in diameter between the outer diameter of the spear and the diameter of the bore defining a space adapted to be flooded with water when the spear gun is used underwater, the flooded space forming a seal between the spear and the bore that substantially prevents the flow of gas from the power load between the spear and the bore;

a breech including a chamber adapted to receive the power load, the chamber being in fluid communication with the bore of the barrel; and means for firing the power load.

2. A spear gun as in claim 1 wherein the spear has an end adapted to be received within the bore, the end including restriction means for restricting the flow of gas past the spear end when the spear end is within the bore.

3. A spear gun as in claim 2 wherein the restriction means includes a plurality of circumferential grooves about the spear end.

4. A spear gun as in claim 1 wherein the means for firing the power load includes a hammer received within a recess, the hammer having a thin cross-section as compared to the cross-section of the recess.

5. A spear gun as in claim 4 wherein the hammer has a flat cross section.

6. A spear gun as in claim 1 where the spear includes a reduced section and the spear gun further includes a line retainer having a central bore adapted to receive the spear, the line retainer including a plurality of moveable pins radially disposed about the central bore and means for biasing the pins inwardly toward the bore, the pins being adapted to slide along the spear and be received within the reduced section.

7. As spear gun as in claim 1 wherein the outside diameter of the spear is substantially 0.010 inch less than the diameter of the bore.

8. A spear gun system comprising:

a power load having no projectile; and a spear oun for use underwater, the spear oun comprising a barrel having an internal bore;

a spear adapted to be received within the bore, the outer diameter of the spear being within a range of about 0.005 to 0.030 inch less than the diameter of the bore, the difference in diameter between the outer diameter of the spear and the diameter of the bore defining a space adapted to be flooded with water when the spear oun is used underwater, the flooded space forming a seal between the spear and the bore that substantially prevents the flow of oas from the power load between the spear and the bore;

a breech including a chamber adapted to receive the power load, the chamber being in fluid communication with the bore of the barrel; and means for firing the power load.

9. A spear gun system as in claim 8 wherein the spear has an end adapted to be received within the bore, the end including a plurality of circumferential grooves about the spear end to restrict the flow of gas past the spear end when the spear end in within the bore.

10. A spear gun for use underwater with an explosive power load, the power load having no projectile, the spear gun comprising:

a barrel having an internal bore;

a spear adapted to be received within the bore, the outer diameter of the spear being substantially 0.010 inch less than the diameter of the bore, the difference in diameter between the outer diameter of the spear and the diameter of the bore defining a space adapted to be flooded with water when the spear gun is used underwater, the flooded space forming a seal between the spear and the bore that substantially prevents the flow of gas from the power load between the spear and the bore, the spear having an end adapted to be received within the bore, the end including a plurality of circumferential grooves about the spear end for further reducing or restricting the flow of gas past the spear end when the spear end is within the bore;

a breech including a chamber adapted to receive the power load, the chamber being in fluid communication with the barrel; and means for firing the power load.

11. A spear gun for use underwater with a power load, the power load having no projectile, the spear gun comprising:

a body including a handle;

a breech including an open chamber adapted for receiving the power load;

a barrel fixed to the breech, the barrel including a bore in fluid communication with the chamber;

means for releasably fixing the breech against the body;

means for sealing the open chamber when the breech is against the body;

a spear adapted to be received within the bore, the outer diameter of the spear being within a range of about 0.005 to 0.030 inch less than the diameter of the bore, the difference in diameter between the outer diameter of the spear and the diameter of the bore defining a space adapted to be flooded with water when the spear gun is used underwater, the flooded space forming a seal between the spear and the bore that substantially prevents the flow of gas from the power load between the spear and the bore; and a trigger mechanism carried by the body, the trigger mechanism including a trigger, a hammer and a guide within which the hammer travels, the hammer having a small cross section as compared to the guide, the trigger mechanism including release means connected to the trigger for releasing the hammer in response to movement of the trigger and means responsive to the hammer for impacting a power load retained within the chamber.

12. A spear gun as in claim 11 wherein the outside diameter of the spear is substantially 0.010 inch less than the diameter of the bore.

* * * * *